US005911265A

United States Patent [19]

Dreher

[11] Patent Number: 5,911,265

[45] Date of Patent: Jun. 15, 1999

[54] INTERCHANGEABLE CURTAIN ASSEMBLY

[76] Inventor: Janet I. Dreher, 108 Mauch Chunk St., Lehighton, Pa. 18235

[21] Appl. No.: 09/004,084

[22] Filed: Jan. 8, 1998

[51] Int. Cl.[6] ..... A47H 1/00

[52] U.S. Cl. ..... 160/124; 160/330

[58] Field of Search ..... 160/124, 123, 160/126, 330, 38, 19, 39, 349.1, 349.2

[56] References Cited

U.S. PATENT DOCUMENTS

| | | | |
|---|---|---|---|
| 1,778,499 | 10/1930 | King | 160/330 |
| 2,500,074 | 3/1950 | Hill | 160/123 |
| 2,520,653 | 8/1950 | Rand | 160/330 X |
| 2,587,492 | 2/1952 | Lipetz | 160/330 X |
| 2,594,624 | 4/1952 | Dubinsky | 160/330 X |
| 2,840,155 | 6/1958 | Stern | 160/124 |
| 2,952,315 | 9/1960 | Brontman | 160/330 |
| 3,164,352 | 1/1965 | Weaver et al. | 160/330 X |
| 5,191,922 | 3/1993 | Wade | 160/124 |
| 5,524,689 | 6/1996 | Clark | 160/124 |
| 5,651,407 | 7/1997 | Perez | 160/330 |
| 5,738,159 | 4/1998 | O'Brien | 160/124 X |

*Primary Examiner*—David M. Purol

[57] ABSTRACT

An interchangeable curtain system is provided including a curtain rod fixedly mounted along a top edge of a window. A valance strip has a first coupling mechanism mounted to a rear face thereof. During use, the sleeve of the valance strip may be removably mounted on the curtain rod. Also included is a plurality of small tabs having a second coupling mechanism formed thereon, whereby each tab may be removably mounted on the curtain rod. At least one curtain is constructed from a flexible cloth material and has a top edge with a third coupling mechanism mounted thereon, whereby the third coupling mechanism is each adapted to be releasably coupled to at least one of the first coupling mechanism and the second coupling mechanism.

5 Claims, 2 Drawing Sheets

10
12
14
16
18
20
22
23
24
25
26
28
30
31
32
2
4
6

INTERCHANGEABLE CURTAIN ASSEMBLY

BACKGROUND OF THE INVENTION

1. Field of the Invention

The present invention relates to curtain assemblies and more particularly pertains to a new interchangeable curtain assembly for providing a versatile method of decorating windows.

2. Description of the Prior Art

The use of curtain assemblies is known in the prior art. More specifically, curtain assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art curtain assemblies include U. S. Pat. No. 5,092,384; U.S. Pat. No. 4,912,829; U.S. Pat. No. 4,972,895; U.S. Pat. No. 5,230,375; U.S. Pat. No. 4,237,958; and U.S. Pat. No. Des. 354,647.

In these respects, the interchangeable curtain assembly according to the present invention substantially departs from the conventional concepts and designs of the prior art, and in so doing provides an apparatus primarily developed for the purpose of providing a versatile method of decorating windows.

SUMMARY OF THE INVENTION

In view of the foregoing disadvantages inherent in the known types of curtain assemblies now present in the prior art, the present invention provides a new interchangeable curtain assembly construction wherein the same can be utilized for providing a versatile method of decorating windows.

The general purpose of the present invention, which will be described subsequently in greater detail, is to provide a new interchangeable curtain assembly apparatus and method which has many of the advantages of the curtain assemblies mentioned heretofore and many novel features that result in a new interchangeable curtain assembly which is not anticipated, rendered obvious, suggested, or even implied by any of the prior art curtain assemblies, either alone or in any combination thereof.

To attain this, the present invention generally includes a curtain rod fixedly mounted along a top edge of a window; a valance strip constructed from a flexible cloth material and having a front face, a rear face, and a periphery formed therebetween with a rectangular configuration, the front face of the valance strip having a plurality of decorations mounted thereon, the rear face of the valance strip having a horizontally oriented sleeve mounted thereon between side edges of the periphery adjacent to a top edge thereof and a plurality of linearly aligned loops mounted thereon between the side edges of the periphery of the valance strip, wherein the valance strip has a length approximately equal to that of the curtain rod, whereby the sleeve of the valance strip may be removably and slidably mounted on the curtain rod; a plurality of small tabs constructed from a flexible cloth material and each with a rectangular configuration having a horizontally oriented sleeve mounted adjacent a top edge thereof and a slit formed therein adjacent to a bottom edge thereof, whereby the sleeves of each tab may be removably and slidably mounted on the curtain rod; a pair of curtains each constructed from a flexible cloth material with a rectangular configuration having a top edge with a plurality of buttons mounted to a front face thereof in linear alignment, whereby the buttons are each adapted to be releasably coupled to at least one of the slits of the tabs and the loops of the valance strip.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new interchangeable curtain assembly apparatus and method which has many of the advantages of the curtain assemblies mentioned heretofore and many novel features that result in a new interchangeable curtain assembly which is not anticipated, rendered obvious, suggested, or even implied by any of the prior art curtain assemblies, either alone or in any combination thereof.

It is another object of the present invention to provide a new interchangeable curtain assembly which may be easily and efficiently manufactured and marketed.

It is a further object of the present invention to provide a new interchangeable curtain assembly which is of a durable and reliable construction.

An even further object of the present invention is to provide a new interchangeable curtain assembly which is susceptible of a low cost of manufacture with regard to both materials and labor, and which accordingly is then susceptible of low prices of sale to the consuming public, thereby making such interchangeable curtain assembly economically available to the buying public.

Still yet another object of the present invention is to provide a new interchangeable curtain assembly which provides in the apparatuses and methods of the prior art some of the advantages thereof, while simultaneously overcoming some of the disadvantages normally associated therewith.

Still another object of the present invention is to provide a new interchangeable curtain assembly for providing a versatile method of decorating windows.

Even still another object of the present invention is to provide a new interchangeable curtain assembly that includes a curtain rod fixedly mounted along a top edge of a window. A valance strip has a first coupling mechanism mounted to a rear face thereof. During use, the sleeve of the valance strip may be removably mounted on the curtain rod. Also included is a plurality of small tabs having a second coupling mechanism formed thereon, whereby each tab may be removably mounted on the curtain rod. At least one curtain is constructed from a flexible cloth material and has a top edge with a third coupling mechanism mounted thereon, whereby the third coupling mechanism is each adapted to be releasably coupled to at least one of the first coupling mechanism and the second coupling mechanism.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2, 3, 4, 5, 6:
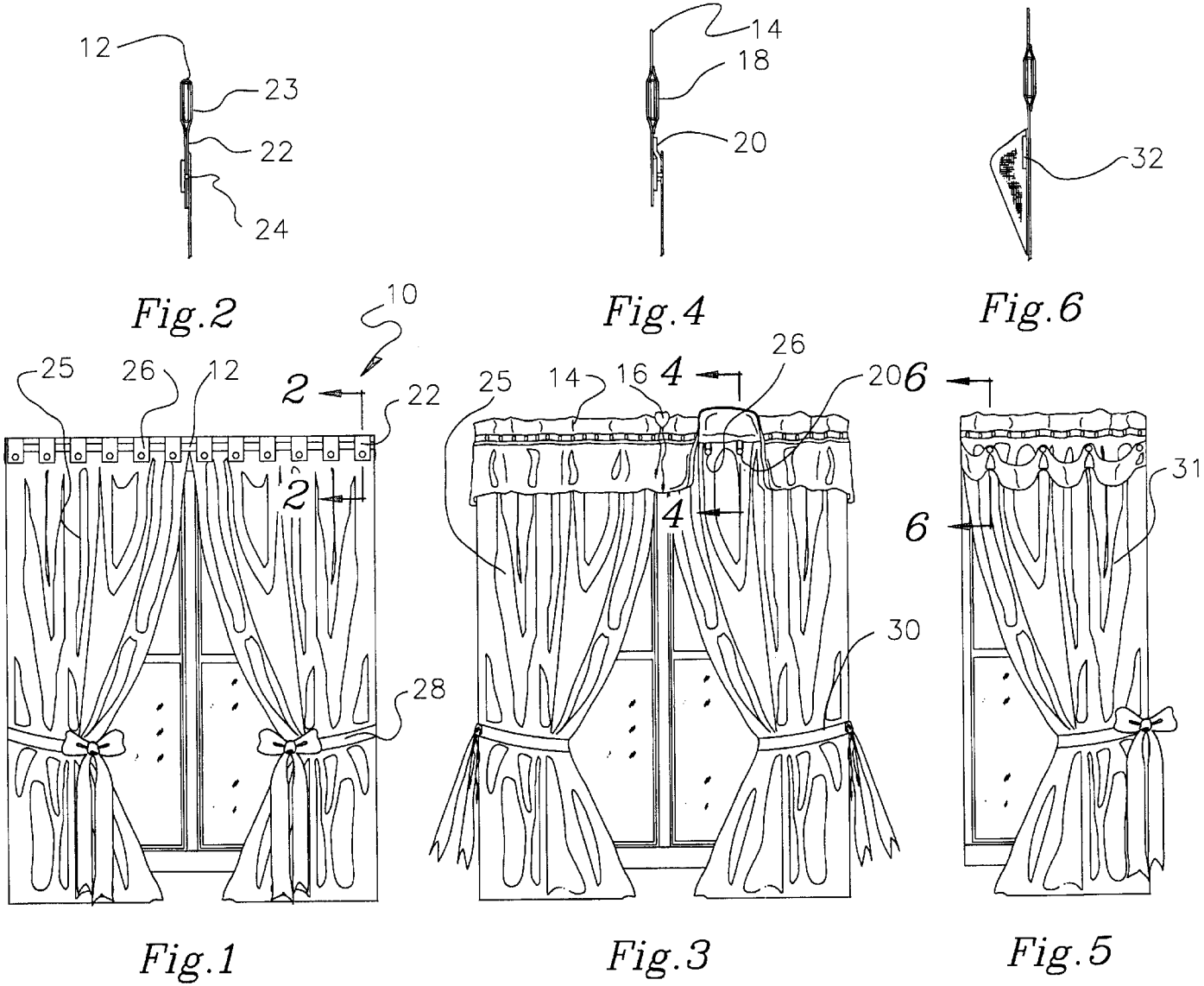
FIG. 1 is a front view of the curtain and small tabs of the present invention.
FIG. 2 is a cross-sectional view of the tabs of the present invention.
FIG. 3 is a front view of the curtain and valance strip of the present invention.
FIG. 4 is a cross-sectional view of the valance strip of the present invention.
FIG. 5 is a front view of an alternate embodiment of the present invention which uses buttons as a coupling mechanism.
FIG. 6 is a cross-sectional view of the alternate embodiment take along line 6—6 shown in FIG. 5.
Figure 10A:
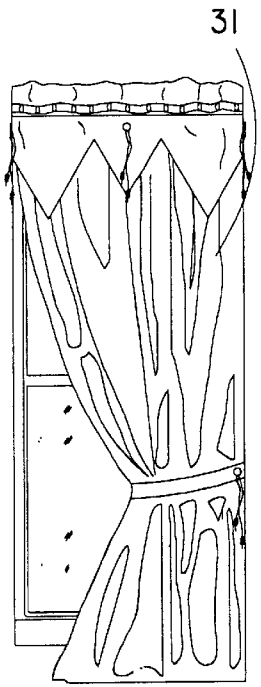
FIGS. 10A and 10B are front views of the alternate embodiment of the present invention that uses buttons as a coupling mechanism.
Figure 10B:
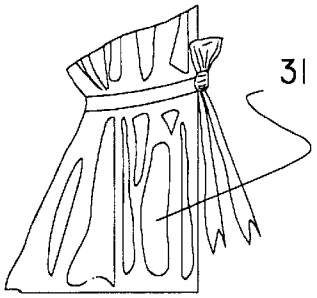

With reference now to the drawings, and in particular to FIGS. 1 through 10B thereof, a new interchangeable curtain assembly embodying the principles and concepts of the present invention and generally designated by the reference numeral 10 will be described.

The present invention, designated as numeral 10, includes a curtain rod 12 fixedly mounted along a top edge of a window. Further provided is a valance strip 14 constructed from a flexible cloth material. As shown in FIG. 3, the valance strip has a front face, a rear face, and a periphery formed therebetween with a rectangular configuration. The front face of the valance strip has a plurality of decorations 16 mounted thereon.

The rear face of the valance strip has a horizontally oriented sleeve 18 mounted thereon between side edges of the periphery adjacent to a top edge thereof and just above the central extent of a central extent of the valance strip. Further, with reference now to both FIGS. 3 & 4, it is shown that a plurality of linearly aligned loops 20 are mounted on the valance strip between the side edges of the periphery thereof. The loops ideally reside just below the central extent of the rear face of the valance strip, as shown in FIG. 4. It should be noted that the valance strip has a length approximately equal to that of the curtain rod. During use, the sleeve of the valance strip may be removably and slidably mounted on the curtain rod.

FIG. 1 shows a plurality of small tabs 22 constructed from a flexible cloth material and each with a rectangular configuration. Preferably, each tab has a length and width less than 1/10 that of the curtain rod. Each tab has a horizontally oriented sleeve 23 mounted adjacent a top edge thereof. A slit 24 is formed therein adjacent to a bottom edge thereof. As such, the sleeves of each tab may be removably and slidably mounted on the curtain rod.

Further provided is a pair of curtains 25 each constructed from a flexible cloth material with a rectangular configuration. Each curtain has a top edge with a plurality of wooden buttons 26 mounted to a front face thereof in linear alignment. During use, the buttons are each adapted to be releasably coupled to at least one of the slits of the tabs and the loops of the valance strip.

For providing a versatile means of decorating the curtain to match the valance strip or small tabs, tie-back sashes are used. A first tie-back sash 28 is removably secured to a central extent of the curtain and has a bow which matches the small tabs. Associated therewith is a second tie-back sash 30 removably secured to a central extent of the curtain and having a pair of ribbons which match the valance strip. It should be noted that many stylistic variations are available to the small tabs, valance strip and sashes including variations of material, accessories, colors, sizes and design.

In an alternate embodiment, at least one curtain 31 is constructed from a flexible cloth material having a top edge with a coupling mechanism mounted thereon. Note FIGS. 5–10. The present embodiment differs from the previous embodiment in that the curtain rod is coupled to the curtain rod directly via a sleeve that is integral therewith. As shown in FIGS. 5–10, various valance strips and other upper border decorative members are each equipped with coupling mechanism mounted to a rear face thereof for being removably mounted to the coupling mechanism of the curtain. As shown in the various Figures, the valance strip may be split with a button coupling, equipped with a bow, have a plurality of triangular cutouts formed therein, and/or have decorations mounted thereon.

Figure 9:
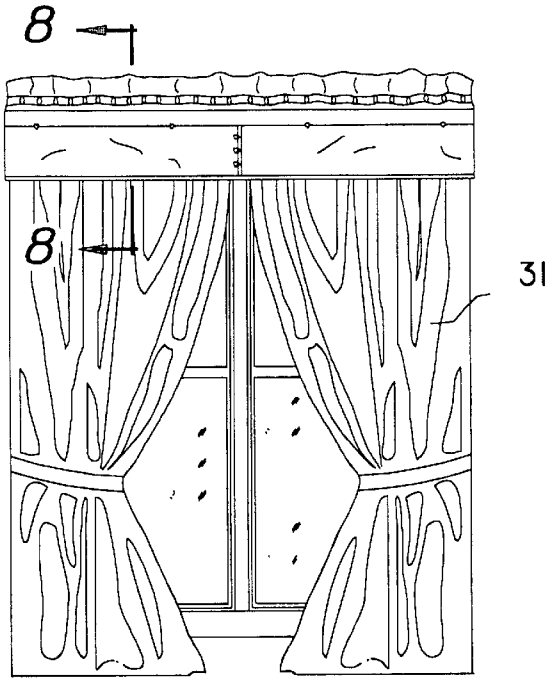
FIG. 9 is a front view of the alternate embodiment of the present invention that uses snaps as a coupling mechanism with an altered valance strip.
Figure 8:
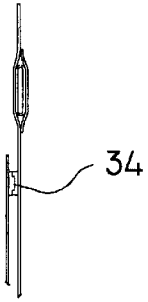
FIG. 8 is a cross-sectional view of the alternate embodiment taken along line 8—8 shown in FIG. 7.
Figure 7:
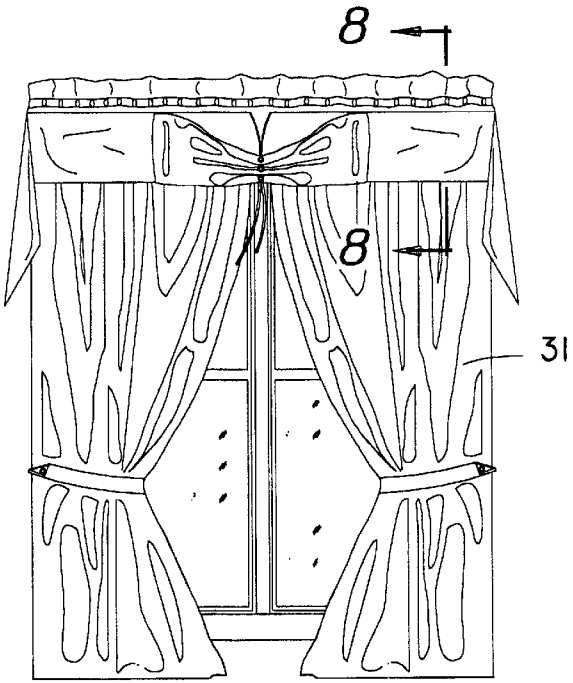
FIG. 7 is a front view of the alternate embodiment of the present invention that uses snaps as a coupling mechanism.

The aforementioned coupling mechanisms of the alternate embodiment may be comprise of a buttons 32, as shown in FIGS. 5, 6, 10A & 10B. In the alternative, snaps 34 may be used, as shown in FIGS. 7–9.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An interchangeable curtain system comprising, in combination:

a curtain rod fixedly mounted along a top edge of a window;

a valance strip constructed from a flexible cloth material and having a front face, a rear face, and a periphery formed therebetween with a rectangular configuration, the front face of the valance strip having a plurality of decorations mounted thereon, the rear face of the valance strip having a horizontally oriented sleeve mounted thereon between side edges of the periphery adjacent to a top edge thereof and a plurality of linearly aligned loops mounted thereon between the side edges of the periphery of the valance strip, wherein the valance strip has a length approximately equal to that of the curtain rod, whereby the sleeve of the valance strip may be removably and slidably mounted on the curtain rod;

a plurality of small tabs constructed from a flexible cloth material and each with a rectangular configuration having a horizontally oriented sleeve mounted adjacent a top edge thereof and a slit formed therein adjacent to a bottom edge thereof, whereby the sleeves of each tab may be removably and slidably mounted on the curtain rod;

a pair of curtains each constructed from a flexible cloth material with a rectangular configuration having a top edge with a plurality of buttons mounted to a front face thereof in linear alignment, whereby the buttons are each adapted to be releasably coupled to at least one of the slits of the tabs and the loops of the valance strip;

a first tie-back sash removably secured to a central extent of the curtain and having a bow which matches the small tabs; and a second tie-back sash removably secured to a central extent of the curtain and having a pair of ribbons which match the valance strip.

2. An interchangeable curtain system comprising:

a curtain rod for fixedly mounting along a top edge of a window;

a valance strip having a front face, a rear face, and a periphery formed therebetween, the front face of the valance strip having a plurality of decorations mounted thereon, the rear face of the valance strip having a horizontally oriented sleeve mounted thereon between side edges of the periphery adjacent to a top edge thereof and a plurality of linearly aligned valence coupling mechanisms mounted thereon between the side edges of the periphery of the valance strip, whereby the sleeve of the valance strip may be removably and slidably mounted on the curtain rod;

a plurality of small tabs having a horizontally oriented sleeve mounted adjacent a top edge thereof and a tab coupling mechanism positioned adjacent to a bottom edge thereof, whereby the sleeves of each tab may be removably and slidably mounted on the curtain rod;

a pair of curtains each constructed from a flexible cloth material having a top edge with a plurality of curtain coupling mechanisms mounted thereon in linear alignment, whereby the curtain coupling mechanisms are each adapted to be releasably coupled to the tab coupling mechanism of one of the tabs and one of the valance coupling mechanisms of the valance strip;

a first tie-back sash removably secured to a central extent of the curtain matching the small tabs; and a second tie-back sash removably secured to a central extent of the curtain matching the valance strip.

3. An interchangeable curtain system as set forth in claim 2 wherein the valance strip and tabs are constructed from a flexible cloth material.

4. An interchangeable curtain system comprising:

a curtain rod for fixedly mounting along a top edge of a window;

a curtain constructed from a flexible cloth material having a top edge with a coupling mechanism mounted thereon for coupling the curtain to the curtain rod;

a plurality of uniquely decorated valance strips each having a coupling mechanism mounted to a rear face thereof for being removably mounted to the coupling mechanism of the curtain;

a first tie-back sash removably secured to a central extent of the curtain; and a second tie-back sash removably secured to a central extent of the curtain, wherein the first tie-back sash is dissimilar to the second tie-back sash.

5. An interchangeable curtain system as set forth in claim 4 wherein the curtain has at least one sleeve for being removably mounted to the curtain rod.

* * * * *